US008652726B2

(12) United States Patent
Fujita et al.

(10) Patent No.: US 8,652,726 B2
(45) Date of Patent: Feb. 18, 2014

(54) TONER FOR DEVELOPING ELECTROSTATIC IMAGE, METHOD OF PRODUCING TONER, CARTRIDGE, IMAGE FORMING METHOD, AND IMAGE FORMING APPARATUS

(75) Inventors: Asafumi Fujita, Kanagawa (JP); Hirokazu Hamano, Kanagawa (JP); Tetsuya Taguchi, Kanagawa (JP); Hiroshi Kamada, Kanagawa (JP); Masahiro Takagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/235,041

(22) Filed: Sep. 16, 2011

(65) Prior Publication Data

US 2012/0251937 A1 Oct. 4, 2012

(30) Foreign Application Priority Data

Mar. 28, 2011 (JP) ..... 2011-070900

(51) Int. Cl.
*G03G 9/00* (2006.01)

(52) U.S. Cl.
USPC ..... 430/108.6; 430/108.1; 430/108.7

(58) Field of Classification Search
USPC ..... 430/108.1, 108.6, 108.7
See application file for complete search history.

(56) References Cited

U.S. PATENT DOCUMENTS

| | | | | |
|---|---|---|---|---|
| 7,160,662 | B2 * | 1/2007 | Yoshino et al. | 430/108.3 |
| 7,354,688 | B2 * | 4/2008 | Silence et al. | 430/108.3 |
| 7,485,400 | B2 * | 2/2009 | Veregin et al. | 430/107.1 |
| 7,537,876 | B2 * | 5/2009 | Anno et al. | 430/108.6 |
| 2003/0118929 | A1 | 6/2003 | Shirai et al. | |
| 2007/0009823 | A1 * | 1/2007 | Skorokhod et al. | 430/108.3 |
| 2009/0035683 | A1 * | 2/2009 | Imafuku et al. | 430/108.7 |
| 2012/0251936 | A1 * | 10/2012 | Hamano et al. | 430/105 |

FOREIGN PATENT DOCUMENTS

| | | |
|---|---|---|
| JP | A-49-091231 | 8/1974 |
| JP | A-56-040868 | 4/1981 |
| JP | A-2003-005436 | 1/2003 |
| JP | A-2003-107781 | 4/2003 |
| JP | A-2004-053710 | 2/2004 |
| JP | A-2004-086005 | 3/2004 |
| JP | A-2004-109200 | 4/2004 |
| JP | A-2006-276060 | 10/2006 |
| JP | A-2008-096539 | 4/2008 |
| JP | A-2010-139643 | 6/2010 |

OTHER PUBLICATIONS

Feb. 19, 2013 Office Action issued in U.S. Appl. No. 13/234,879.
U.S. Appl. No. 13/234,879 to Hamano et al. filed Sep. 16, 2011.
Jun. 21, 2013 Office Action issued in U.S. Appl. No. 13/234,879.
Oct. 18, 2013 Office Action issued in U.S. Appl. No. 13/234,879.

* cited by examiner

*Primary Examiner* — Stewart Fraser
(74) *Attorney, Agent, or Firm* — Oliff & Berridge, PLC

(57) ABSTRACT

A toner for developing an electrostatic image, includes: colored particles containing a colorant and a binder resin, and two or more kinds of inorganic particles that are externally added to a surface of the colored particles, in which the two or more kinds of inorganic particles contain titanium-containing particles and silica-containing particles, an exposure ratio of the surface of the colored particles is about 25% or less, and a ratio of the silica-containing particles that are in contact with the colored particles is about 10% by number or less.

12 Claims, 3 Drawing Sheets

ATTACHING METHOD OF TITANIUM BASED PARTICLES

TONER FOR DEVELOPING ELECTROSTATIC IMAGE, METHOD OF PRODUCING TONER, CARTRIDGE, IMAGE FORMING METHOD, AND IMAGE FORMING APPARATUS

CROSS-REFERENCE TO RELATED APPLICATION

This application is based on and claims priority under 35 USC 119 from Japanese Patent Application No. 2011-070900 filed on Mar. 28, 2011.

BACKGROUND

1. Technical Field

The present invention relates to a toner for developing an electrostatic image, a method of producing the toner, a cartridge, an image forming method, and an image forming apparatus.

2. Related Art

A method of visualizing image information through an electrostatic latent image, for example, an electrophotographic process, is currently applied to various fields of art. In the electrophotographic process, an electrostatic latent image is formed on a surface of a photoconductor through charging and exposing, and the electrostatic latent image is developed with a developer containing a toner, and then visualized through transferring and fixing.

A dry developer is roughly classified into a single-component developer using a toner containing a colorant dispersed in a binder resin, and a two-component developer containing the toner and a carrier. Examples of the single-component developer include a magnetic single-component toner using a magnetic toner, and a non-magnetic single-component toner using a non-magnetic toner.

SUMMARY

According to an aspect of the invention, there is provided a toner for developing an electrostatic image, including:

colored particles containing a colorant and a binder resin, and two or more kinds of inorganic particles that are externally added to a surface of the colored particles, wherein the two or more kinds of inorganic particles contain titanium-containing particles and silica-containing particles, an exposure ratio of the surface of the colored particles is about 25% or less, and a ratio of the silica-containing particles that are in contact with the colored particles is about 10% by number or less.

BRIEF DESCRIPTION OF THE DRAWINGS

Exemplary embodiments of the present invention will be described in detail based on the following figures, wherein.

DETAILED DESCRIPTION

Figure 1:
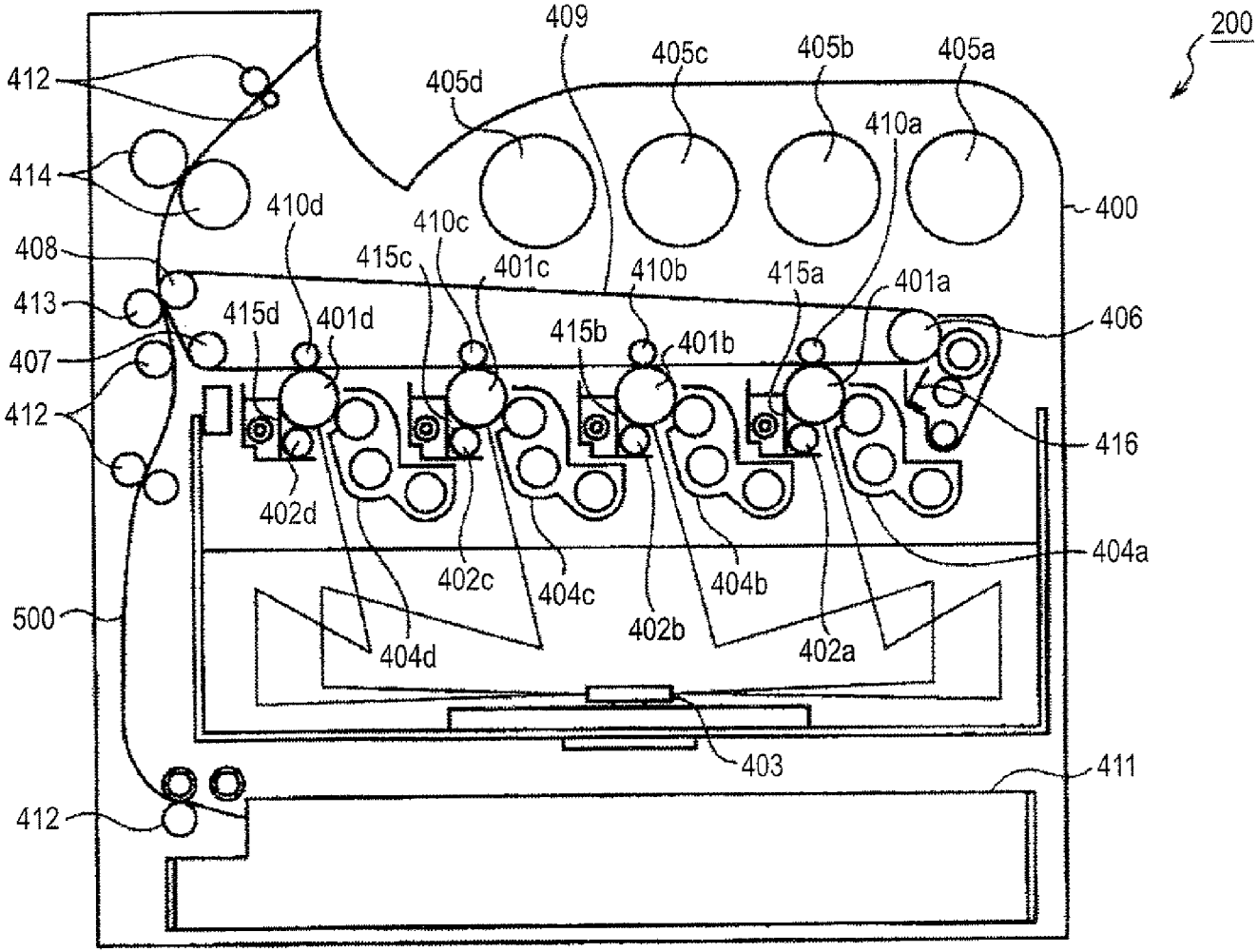
FIG. 1 is a schematic cross sectional view showing one example of an image forming apparatus using a two-component developer according to an exemplary embodiment.

Exemplary embodiments of the invention are described in detail below.

Toner for Developing Electrostatic Image

A toner for developing an electrostatic image according to the exemplary embodiment includes: colored particles containing a colorant and a binder resin, and two or more kinds of inorganic particles that are externally added to a surface of the colored particles, in which the two or more kinds of inorganic particles contain titanium-containing particles and silica-containing particles, an exposure ratio of the surface of the colored particles is about 25% or less, and a ratio of the silica-containing particles that are in contact with the colored particles is about 10% by number or less.

Measurement Method of Exposure Ratio of Surface of Colored Particles

The exposure ratio (E) of the surface of the colored particles in the exemplary embodiment may be obtained from a measured coverage of the silica-containing particles (Cs) on the surface of the colored particles and a measured coverage of the titanium-containing particles (Ct) on the surface of the colored particles. Specifically, the measured coverages Cs and Ct may be obtained by measuring the colored particles solely, the silica-containing particles solely, the titanium-containing particles solely, and the toner containing the silica-containing particles and the titanium-containing particles, for signal intensities of silicon atom and titanium atom respectively with an X-ray photoelectron spectroscopy (XPS) apparatus (JPS-9000MX, available from JEOL, Ltd.), and calculating according to the following expressions (1) and (2).

$$Cs=(Ps-Ns)/(Ts-Ns)\times 100(\%) \quad (1)$$

$$Ct=(Pt-Nt-Cs\times Tt)/(St-Nt)\times 100(\%) \quad (2)$$

Accordingly, the exposure ratio (E) may be calculated according to the following expression (3).

$$E=100-Cs-Ct(\%) \quad (3)$$

In the expressions (1) and (2), Ps represents the signal intensity of silicon atom derived from the silica-containing particles and the titanium-containing particles of the toner containing the silica-containing particles and the titanium-containing particles, Pt represents the signal intensity of titanium atom derived from the silica-containing particles and the titanium-containing particles of the toner, St represents the signal intensity of titanium atom derived from the silica-containing particles of the silica-containing particles solely, Ts represents the signal intensity of silicon atom derived from the titanium-containing particles of the titanium-containing particles solely, Tt represents the signal intensity of titanium atom derived from the titanium-containing particles of the titanium-containing particles solely, Ns represents the signal intensity of silicon atom of the colored particles solely, and Nt represents the signal intensity of titanium atom of the colored particles solely.

Measurement Method of Ratio of Silica-containing particles that are in direct contact with Surface of Colored Particles In the exemplary embodiment, the ratio of the silica-containing particles that are in direct contact with the surface of the colored particles (% by number) is obtained in the following manner. The language "the ratio of the silica-containing particles that are in contact with the colored particles" means the ratio of the titanium-containing particles that are in direct contact with the surface of the colored particles.

A micrograph of the toner with a magnification of 30,000 is taken with a scanning electron microscope (FE-SEM S-4500, available from Hitachi, Ltd.). The number of the silica-containing particles that are in contact with the colored particles is counted visually, and the ratio of the silica-containing particles that are in contact with the surface of the colored particles is calculated. In the exemplary embodiment, 10 toner particles randomly selected are investigated, and the average value thereof is designated as the ratio of the silica-containing particles that are in contact with the surface of the colored particles.

In the determination as to whether or not a silica-containing particle is in contact with a colored particle, it is determined that the silica-containing particle is not in contact with the colored particle in the case where a titanium-containing particle under the silica-containing particle is visually observed around the silica-containing particle, and it is determined that the silica-containing particle is in contact with the colored particle in the case where a titanium-containing particle under the silica-containing particle is not visually observed around the silica-containing particle.

External Additive

The toner for developing an electrostatic image of the exemplary embodiment has two or more kinds of inorganic particles that are externally added as external additives to the surface of the colored particles, in which the two or more kinds of inorganic particles contain titanium-containing particles and silica-containing particles, the exposure ratio of the surface of the colored particles is 25% or less (or about 25% or less), and the ratio of the silica-containing particles that are in contact with the surface of the colored particles is 10% by number or less (or about 10% by number or less).

In the toner for developing an electrostatic image of the exemplary embodiment, the exposure ratio of the surface of the colored particles is 25% or less, and the ratio of the silica-containing particles that are in contact with the surface of the colored particles (which may be referred to as the contact ratio) is 10% by number or less, that is the ratio of the silica-containing particles that are in direct contact with the surface of the colored particles is lowered. Accordingly, it is expected that the silica-containing particles may be prevented from being buried under the surface of the colored particles with thermal history and mechanical stress, thereby maintaining the fluidity with the lapse of time. Accordingly, it is expected that the use of the toner for developing an electrostatic image of the exemplary embodiment decrease the fluctuation in image density upon repeated formation of images.

It is also expected that in the toner for developing an electrostatic image of the exemplary embodiment, the titanium-containing particles buried under the colored particles function as a filler to prevent the toner from being deformed. Accordingly, it is expected that the use of the toner for developing an electrostatic image of the exemplary embodiment prevents the toner from being deposited on a blade in a developing device upon repeated formation of images.

The toner for developing an electrostatic image of the exemplary embodiment may be preferably produced in such a manner that the titanium-containing particles are firstly added to the surface of the colored particles without overlapping in the radial direction of the colored particles, and then the silica-containing particles are externally added thereto. In the toner for developing an electrostatic image of the exemplary embodiment, the titanium-containing particles may be preferably added to the surface of the colored particles to form single layer without overlapping in the radial direction of the colored particles. When the titanium-containing particles are added to form single layer, it is expected that the amount of titanium-containing particles positioned as an upper layer of the overlap is small, and thus the amount the titanium-containing particles that are released off is decreased, thereby suppressing contamination caused by transfer of the titanium-containing particles to a carrier, a developer holding member, a photoconductor or the like. The addition in single layer may be confirmed directly by observation with an optical or electron microscope, or may be quantitatively confirmed by achieving the prescribed exposure ratio of the colored particles within the range of addition amount described later.

The exposure ratio of the surface of the colored particles may be preferably 23% or less, and more preferably 20% or less. The lower limit of the exposure ratio of the surface of the colored particles is not particularly limited, and may be 2% or more (or about 2% or more), and preferably 3% or more, from the standpoint of production.

Titanium-Containing Particles

The toner for developing an electrostatic image of the exemplary embodiment contains the two or more kinds of inorganic particles that are externally added as an external additive to the surface of the colored particles, and the two or more kinds of inorganic particles contain titanium-containing particles.

The toner for developing an electrostatic image of the exemplary embodiment has an exposure ratio of the surface of the colored particles of 25% or less, and a ratio of the silica-containing particles that are in contact with the surface of the colored particles is 10% by number or less. Therefore, a larger amount of the titanium-containing particles are in contact with the surface of the colored particles than the silica-containing particles, and the toner for developing an electrostatic image of the exemplary embodiment may preferably have at least single layer formed with the titanium-containing particles added to the surface of the colored particles.

The layer formed with the titanium-containing particles added to the surface of the colored particles may not cover the entire surface of the colored particles but provides an exposure ratio on the surface of the colored particles of 25% or less. Accordingly, there may be a portion where the surface of the colored particles is exposed is present among the titanium-containing particles added to the surface of the colored particles, and the surface of the colored particles may have a portion where no titanium-containing particle is added and a portion where the silica-containing particles are added.

Examples of the titanium-containing particles include anatase type titanium oxide particles, rutile type titanium oxide particles and metatitanic acid particles. Among these, metatitanic acid ($TiO(OH)_2$) particles may be preferably used since metatitanic acid particles may not affect the transparency easily.

In the case where metatitanic acid particles are used as the titanium-containing particles, the binder resin of the colored particles may more preferably contain a polyester resin since metatitanic acid particles have large affinity with a polyester resin and exert a large hiding power of the surface of the colored particles.

The titanium-containing particles may have a volume average particle diameter of from 8 nm to 50 nm (or from about 8 nm to about 50 nm), and preferably from 10 nm to 40 nm. When the volume average particle diameter of the titanium-containing particles is 8 nm or more, the particles may have good dispersibility, and when the volume average particle diameter is 50 nm or less, the particles may be prevented from being released from the toner.

The production method of the titanium-containing particles is not particularly limited and may be any known production method, and examples thereof include a vapor phase production method, a wet production method, a sol-gel production method and the like.

The titanium-containing particles may be subjected to a surface treatment, for example, may be subjected to a surface treatment for imparting hydrophobicity with a silane coupling agent, a titanium coupling agent, a silicone oil or the like. The titanium-containing particles having a hydrophobic surface have low affinity to the surface of the colored particle, which further prevents the titanium-containing particles from being buried under the surface. The material used for the surface treatment may be a silane coupling agent, which may provide favorable charging property and fluidity.

The amount of the titanium-containing particles added may be such an amount that provides a coverage on the colored particles of from 80% to 140%, and preferably an amount that provides a coverage of from 90% to 135% (or from about 90% to about 135). When the amount provides a coverage of 80% or more, the intended exposure ratio may be obtained by easily providing single layer containing the titanium-containing particles added to the surface of the colored particles. When the coverage is 140% or less, the titanium-containing particles may be added in single layer to the surface of the colored particles, a less amount of the titanium-containing particles remaining, and the probability of forming the addition mode with two or more layers may be small. When the amount of the titanium-containing particles is such an amount that provides a coverage of from 90% to 135% (more preferably from 100% to 130%) on the colored particles, there is a tendency that generation of white streaks may be securely prevented upon forming images owing to the aforementioned mechanisms.

The coverage of the titanium-containing particles on the toner particles may be obtained according to the following expression.

$$\text{coverage}(\%)=(\sqrt{3}/(2\pi))\times(dt/da)\times(\rho t/\rho a)\times C\times 100$$

wherein da: the weight average particle diameter of the external additive (titanium-containing particles), dt: the weight average particle diameter of the toner particles, ρa: the true specific gravity of the external additive, ρt: the true specific gravity of the toner particles, C: the ratio (weight of external additive)/(weight of toner particles)

Silica-Containing Particles

The toner for developing an electrostatic image of the exemplary embodiment contains the two or more kinds of inorganic particles that are externally added as an external additive to the surface of the colored particles, and the two or more kinds of inorganic particles contain silica-containing particles.

The toner for developing an electrostatic image of the exemplary embodiment has an exposure ratio of the surface of the colored particles of 25% or less, and a ratio of the silica-containing particles that are in direct contact with the surface of the colored particles is 10% by number or less. Therefore, 90% by number or more of the silica-containing particles are not in direct contact with the colored particles but are present on the titanium-containing particles that are added directly to the surface of the colored particles. In the toner for developing an electrostatic image of the exemplary embodiment, 90% by number or more of the silica-containing particles may be present on the layer formed with the titanium-containing particles added directly to the surface of the colored particles.

Examples of the silica-containing particles include silica particles, such as fumed silica, colloidal silica and silica gel. The silica-containing particles may be subjected to a surface treatment, for example, may be subjected to a surface treatment for imparting hydrophobicity with a silane coupling agent, a silicone oil or the like. The material used for the surface treatment may be a silane coupling agent, which may provide favorable charging property and fluidity.

The silica-containing particles may have a volume average particle diameter of from 5 nm to 40 nm (or from about 5 nm to about 40 nm), and preferably from 7 nm to 30 nm. When the volume average particle diameter of the silica-containing particles is 5 nm or more, the silica-containing particles may be easily added to the surface of the colored particles while preventing unevenness. When the volume average particle diameter is 40 nm or less, charging property and fluidity may be favorably obtained.

The production method of the silica-containing particles is not particularly limited and may be any known production method, and examples thereof include a vapor phase production method, a wet production method, a sol-gel production method and the like.

The amount of the silica-containing particles added may be such an amount that provides a coverage on the colored particles of 10 to 50%, and preferably from 15 to 45%. When the amount provides a coverage in the range, sufficient charge exchangeability may be obtained. When the amount provides a coverage of 50% or less, the particles may be prevented from being released from the toner.

The coverage of the silica-containing particles on the colored particles may be calculated in the same manner as in the coverage of the titanium-containing particles on the colored particles.

In the case where the amounts of the titanium-containing particles and the silica-containing particles added are in the aforementioned ranges, respectively, the amounts of the titanium-containing particles and the silica-containing particles added may be preferably such amounts that the total of the coverage of the titanium-containing particles on the colored particles and the coverage of the silica-containing particles on the colored particles is 150% or less (or about 150% or less). In this case, it is expected that the titanium-containing particles and the silica-containing particles may be retained on the toner for developing an electrostatic image without drop-off, and thus prevented from being transferred to other members or the like.

The ratio of coverage of the titanium-containing particles to the silica-containing particles may be from 1/1 to 1/10 (or from about 1/1 to about 1/10) based on the addition amounts.

The toner for developing an electrostatic image of the exemplary embodiment may contain an additional external additive in such an amount that does not impair the advantages of the exemplary embodiment, and may contain only the titanium-containing particles and the silica-containing particles as an external additive.

Examples of the additional external additive include inorganic particles, such as alumina and cerium oxide, and organic particles, such as polymethyl methacrylate (PMMA) particles.

Colored Particles

The colored particles in the toner for developing an electrostatic image of the exemplary embodiment contain at least a colorant and a binder resin.

The colored particles may further contain, in addition to these components, other components, such as a release agent.

Binder Resin

The binder resin in the exemplary embodiment is not particularly limited, and known resins for colored particles may be used. For example, a polyester resin may be used from the standpoint of low temperature fixing property, and an amorphous (non-crystalline) polyester resin may preferably be used. The polyester resin may be synthesized, for example, through polycondensation of mainly a polyvalent carboxylic acid and a polyol.

The amorphous polyester resin referred herein means a resin that exhibits stepwise endothermic change without clear peaks in differential scanning calorimetry (which may be hereinafter abbreviated as DSC).

Colorant

The colored particles contain a colorant.

The colorant may be either a dye or a pigment, and may be preferably a pigment from the standpoint of light resistance and water resistance. The colorant is not limited to a chromatic colorant and may be a white colorant and a colorant exhibiting metallic color.

Examples of the colorant include known pigments, such as carbon black, Aniline Black, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, lamp black, Rose Bengal, quinacridone, Benzidine Yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1 and C.I. Pigment Blue 15:3.

In the exemplary embodiment, the content of the colorant in the toner for developing an electrostatic image may be in a range of from 1 part by weight to 30 parts by weight per 100 parts by weight of the binder resin.

A colorant having been subjected to a surface treatment may be used, and a pigment dispersant may be used. A colored toner, such as a yellow toner, a magenta toner, a cyan toner and a black toner, may be obtained by selecting the kind of the colorants.

Release Agent

The colored particles may contain a release agent.

Examples of the release agent include paraffin wax, such as low molecular weight polypropylene and low molecular weight polyethylene, a silicone resin, a rosin compound, rice wax, and carnauba wax.

The release agent may have a melting temperature of from 50° C. to 100° C., and preferably from 60° C. to 95° C.

The content of the release agent in the colored particles may be from 0.5% to 15% by weight, and preferably from 1.0% to 12% by weight. When the content of the release agent is 0.5% by weight or more, releasing failure may be prevented from occurring particularly in oil-less fixing. When the content of the release agent is 15% by weight or less, the fluidity of the toner may be prevented from being deteriorated, thereby ensuring the image quality and the reliability of image formation.

Other Additives

The colored particles may contain, in addition to the aforementioned components, various components, such as an internal additive and a charge controlling agent.

Examples of the internal additive include a magnetic material, for example, ferrite, magnetite, a metal, such as reduced iron, cobalt, nickel and manganese, alloys of these metals, and compounds of these metals.

Examples of the charge controlling agent include a quaternary ammonium salt compound, a nigrosine compound, a dye containing a complex of aluminum, iron, chromium or the like, and a triphenylmethane pigment.

Characteristics of Toner

The toner for developing an electrostatic image of the exemplary embodiment may have a shape factor SF1 of from 115 to 140, and preferably from 120 to 138.

The shape factor SF1 may be obtained according to the following expression.

$$SF1=((ML)^2/A)\times(\pi/4)\times 100$$

wherein ML represents the absolute maximum length of the toner particles, and A represents the projected area of the toner particles.

The shape factor SF1 may be determined as numerical values by analyzing mainly a micrograph of an optical microscope or a scanning electron microscope (SEM) with an image analyzer. For example, an optical micrograph of the particles dispersed on a surface of slide glass is input in Luzex Image Analyzer through a video camera, 100 particles are measured for maximum length and projected area and calculated for shape factor according to the expression, and the obtained values are averaged.

The toner for developing an electrostatic image of the exemplary embodiment may have a volume average particle diameter of from 3 μm to 9 μm, preferably from 3.1 μm to 8.5 μm, and more preferably from 3.2 μm to 8.0 μm. When the volume average particle diameter is 3 μm or more, the fluidity may be prevented from being lowered, and the charging property may be maintained. When the volume average particle diameter is 9 μm or less, the resolution may be prevented from being decreased. The volume average particle diameter may be measured with such a measuring apparatus as Coulter Multisizer II (available from Beckman Coulter, Inc.).

Production Method of Toner for Developing Electrostatic Image

The production method of the toner for developing an electrostatic image of the exemplary embodiment is not particularly limited as far as a toner that satisfies the factors described above may be obtained, and such a method may be employed that contains, for example, preparation of the colored particles containing a colorant and a binder resin (which may be hereinafter referred to as preparation of colored particles), addition of the titanium-containing particles to the colored particles in an aqueous medium, through wet external addition to provide the colored particles having the titanium-containing particles added (which may be hereinafter referred to as external addition of titanium-containing particles), and addition of the silica-containing particles to the colored particles having the titanium-containing particles added, through dry external addition (which may be hereinafter referred to as external addition of silica-containing particles).

Preparation of Colored Particles

The production method of the toner for developing an electrostatic image of the exemplary embodiment may contain the preparation of the colored particles containing a colorant and a binder resin (preparation of colored particles).

The preparation method of the colored particles in the preparation of the colored particles is not particularly limited, and examples of the preparation method include known methods, for example, a dry method, such as a kneading and pulverizing method, a wet method, such as a melting and suspension method, an emulsification and aggregation method and a dissolution and suspension method.

External Addition of Titanium-Containing Particles

The production method of the toner for developing an electrostatic image of the exemplary embodiment may contain the addition of the titanium-containing particles to the colored particles in an aqueous medium, through wet external addition to provide the colored particles having the titanium-containing particles added (external addition of titanium-containing particles).

In the wet external addition, the titanium-containing particles are added without overlapping in the radial direction of the colored particles irrespective of the shape of the colored particles. Accordingly, the added state in single layer of the titanium-containing particles is realized, which is not achieved by dry external addition.

The external addition of titanium-containing particles may include, for example, addition of titanium-containing particles to the surface of the colored particles in an aqueous medium by adding the titanium-containing particles to the dispersion liquid of the colored particles, and drying of the obtained colored particles having the titanium-containing particles added.

Examples of the aqueous medium used in the exemplary embodiment include water, such as distilled water and ion exchanged water, and an alcohol, such as ethanol and methanol. Among these, ethanol and water are preferred, and water, such as distilled water and ion exchanged water, is more preferred. The aqueous medium may be used solely or as a combination of two or more kinds thereof.

The aqueous medium may contain a water miscible organic solvent. Examples of the water miscible organic solvent include acetone and acetic acid.

The dispersion liquid of the colored particles in the addition of titanium-containing particles may have a solid content ratio of 30% or more, and preferably 35% or more. When the solid content ratio is 30% or more, the titanium-containing particles may be added without overlapping in the radial direction of the colored particles through a hetero-aggregation mechanism.

As a method of adding the titanium-containing particles to the dispersion liquid of the colored particles, the titanium-containing particles in a solid state (i.e., in the form of powder) may be added directly to the dispersion liquid of the colored particles, or a dispersion liquid having the titanium-containing particles dispersed therein may be added to the dispersion liquid of the colored particles. The titanium-containing particles that have been subjected to a hydrophobic treatment are hard to be dispersed in the aqueous medium, and therefore, the titanium-containing particles having been dispersed in a mixed solvent of methanol and water in advance may be added to the dispersion liquid of the colored particles. The mixing ratio of methanol and water (methanol/water) in the mixed solvent may be preferably from 1/9 to 5/5.

In the addition of titanium-containing particles, the titanium-containing particles may be added to the colored particles by making the pH of the dispersion liquid of the colored particles having the titanium-containing particles added thereto acidic under stirring of the dispersion liquid. The range of the pH may be of from 2 to 6.5, and preferably from 3 to 6. When the pH is 6.5 or less, dissociation of a carboxylic acid and the like on the surface of the colored particles is prevented from occurring, and thereby the silica-containing particles may be added without overlapping in the radial direction of the colored particles.

The amount of the titanium-containing particles added may be such an amount that provides a coverage on the colored particles of from 80% to 140%, and preferably from 90% to 135%.

Figure 3:
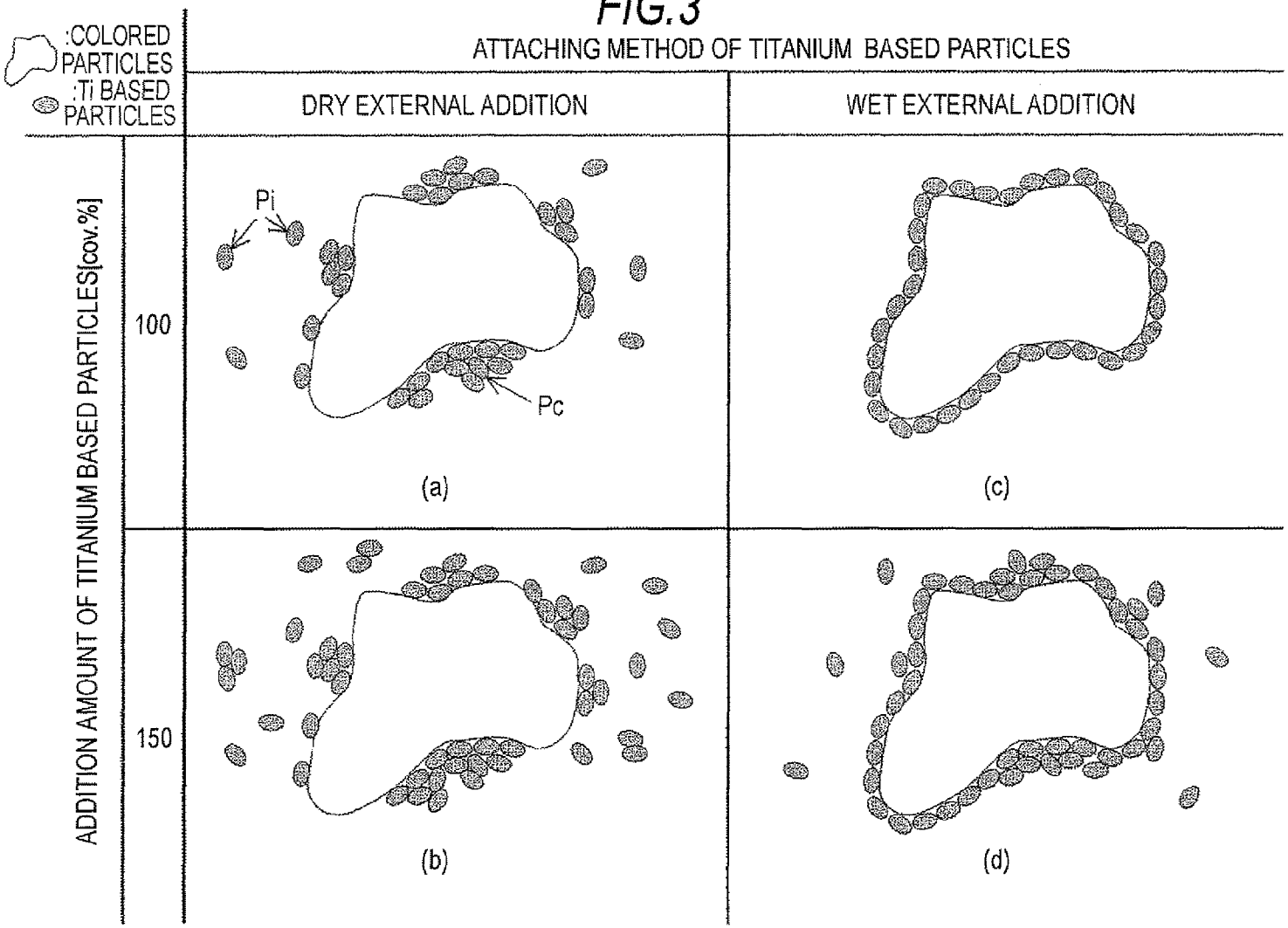
FIG. 3 is a schematic illustration showing a difference in an external addition state of titanium-containing particles to colored particles depending on an adhesion method.

FIG. 3 is a schematic illustration showing the difference in the external addition state of the titanium-containing particles to the colored particles depending on the adhesion method. The states (c) and (d) may be employed in the exemplary embodiment, and the state (c) may be preferred.

The state (a) in FIG. 3 schematically shows an example where the titanium-containing particles in an amount corresponding to a coverage of 100% are added to the colored particles by dry external addition.

In the state (a) in FIG. 3, it is observed that the titanium-containing particles form aggregates Pc and are externally added in the form of aggregates Pc to the colored particles, and the surface of the colored particles is exposed frequently. Furthermore, it is also observed that the titanium-containing particles partly form free particles Pi.

The state (b) in FIG. 3 schematically shows an example where the titanium-containing particles in an amount corresponding to a coverage of 150% are added to the colored particles by dry external addition.

In the state (b) in FIG. 3, as similar to the state (a) in FIG. 3, it is observed that the titanium-containing particles form aggregates Pc and are externally added in the form of aggregates Pc to the colored particles, and the surface of the colored particles is exposed frequently. Furthermore, it is also observed that the titanium-containing particles partly form free particles Pi.

The state (c) in FIG. 3 schematically shows an example where the titanium-containing particles in an amount corresponding to a coverage of 100% are added to the colored particles by wet external addition.

In the state (c) in FIG. 3, it is observed that the titanium-containing particles do not form aggregates Pc and are externally added in the form of single layer on the colored particles, and the surface of the colored particles is substantially not exposed. Furthermore, it is also observed that the titanium-containing particles substantially do not form free particles Pi.

The state (d) in FIG. 3 schematically shows an example where the titanium-containing particles in an amount corresponding to a coverage of 150% are added to the colored particles by wet external addition.

In the state (d) in FIG. 3, it is observed that the titanium-containing particles do not form aggregates Pc and are externally added in the form of one or more layers on the colored particles, and the surface of the colored particles is substantially not exposed. Furthermore, it is also observed that the titanium-containing particles are partly on top of others and free particles Pi.

The colored particles having been subjected to the addition of titanium-containing particles are subjected to solid-liquid separation by filtration and then subjected to the drying by freeze vacuum drying, thereby providing the colored particles having the titanium-containing particles added thereto. The colored particles having the titanium-containing particles added thereto may be subjected to rinsing where the colored particles are rinsed before the drying.

External Addition of Silica-Containing Particles

The production method of the toner for developing an electrostatic image of the exemplary embodiment may contain the addition of the silica-containing particles to the colored particles having the titanium-containing particles added thereto, through dry external addition (external addition of silica-containing particles).

In the addition of silica-containing particles, examples of the method of externally adding the silica-containing particles to the surface of the colored particles having the titanium-containing particles added thereto include a known dry external addition method. Examples of a mixer used in the dry external addition method include known mixers, such as a V-blender, a Henschel mixer and a Loedige mixer.

By the dry external addition of the silica-containing particles to the colored particles having the titanium-containing particles added, the silica-containing particles are externally added onto the layer of the titanium-containing particles, and thus the probability of contact of the silica-containing particles to the surface of the colored particles is decreased, thereby providing the toner having a contact ratio of the silica-containing particles to the surface of the colored particles of 10% by number or less.

Another external additive may be added along with the external addition of titanium-containing particles and the external addition of silica-containing particles.

Developer for Developing Electrostatic Image

The toner for developing an electrostatic image of the exemplary embodiment may be used as a non-magnetic single-component developer or a two-component developer. In the case where the toner is used as a two-component developer, the toner may be mixed with a carrier.

The carrier used in the two-component developer is not particularly limited, and known carriers may be used. Examples of the carrier include iron oxide, a magnetic metal, such as nickel and cobalt, a magnetic oxide, such as ferrite and magnetite, a resin coated carrier having a resin coating layer on these materials as a core, a magnetic material dispersed carrier, and a resin dispersed carrier which contains electroconductive material dispersed in a matrix resin.

Examples of the coating resin and the matrix resin used for the carrier include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a linear silicone resin containing organosiloxane bonds and a modified product thereof, a fluorine resin, polyester, polycarbonate, a phenol resin and an epoxy resin, but the resins are not limited to these examples.

Examples of the electroconductive material include a metal, such as gold, silver and copper, carbon black, titanium oxide, zinc oxide, barium sulfate, aluminum borate, potassium titanate and tin oxide, but the electroconductive material is not limited to these examples.

Examples of the core material of the carrier include a magnetic metal, such as iron, nickel and cobalt, a magnetic oxide, such as ferrite and magnetite, and glass beads, and a magnetic material may be preferably used when the carrier is applied to a magnetic brush system. The volume average particle diameter of the core material of the carrier may be in a range of from 10 μm to 500 μm, and preferably from 30 μm to 100 μm.

Examples of the method for coating the resin on the surface of the core material of the carrier include a method of coating a solution for forming the resin coating layer, which contains the coating resin and other additives depending on necessity, dissolved in an appropriate solvent. The solvent is not particularly limited, and may be selected in consideration of the coating resin used, the coating suitability and the like.

Specific examples of the method of coating the resin include a dipping method of dipping the core material of the carrier in the solution for forming the coating layer, a spraying method of spraying the solution for forming the coating layer onto the surface of the core material of the carrier, a fluidized bed method of spraying the solution for forming the coating layer onto the surface of the core material of the carrier that is in a fluidized state with fluidizing air, and a kneader-coater method of mixing the core material of the carrier and the solution for forming the coating layer in a kneader-coater, followed by removing the solvent.

The mixing ratio (by weight) of the toner for developing an electrostatic image of the exemplary embodiment and the carrier in the two-component developer may be a toner/carrier ratio of from 1/100 to 30/100, and preferably from 3/100 to 20/100.

Cartridge, Image forming Method and Image forming Apparatus

The cartridge according to the exemplary embodiment is described below.

The cartridge of the exemplary embodiment may accommodate at least the toner for developing an electrostatic image of the exemplary embodiment or the developer for developing an electrostatic image of the exemplary embodiment. The cartridge of the exemplary embodiment may be preferably detachable from an image forming apparatus.

In the case where the cartridge is applied to an image forming method or an image forming apparatus, the cartridge may be a toner cartridge accommodating the toner of the exemplary embodiment solely, a developer cartridge accommodating the developer for developing an electrostatic image of the exemplary embodiment, or a process cartridge containing at least a developing unit that forms a toner image through development of an electrostatic latent image formed on an image holding member, with the toner for developing an electrostatic image of the exemplary embodiment or the developer for developing an electrostatic image of the exemplary embodiment.

The process cartridge of the exemplary embodiment may further contain other members, such as an erasing unit, depending on necessity.

The image forming method of the exemplary embodiment may contain: latent image formation of forming an electrostatic latent image on a surface of an image holding member; development of developing the electrostatic latent image formed on the surface of the image holding member, with a toner, to form a toner image; transferring the toner image formed on the surface of the image holding member, to a surface of a transfer medium; and fixing the toner image transferred to the surface of the transfer medium, in which the toner may be the toner for developing an electrostatic image of the exemplary embodiment.

The toner may be the toner for developing an electrostatic image of the exemplary embodiment or a two-component developer containing the toner for developing an electrostatic image of the exemplary embodiment and a carrier.

In the image forming method of the exemplary embodiment, a developer containing the toner for developing an electrostatic image of the exemplary embodiment may be prepared, an electrostatic image may be formed and developed with the developer in an ordinary electrophotographic copying machine, and the obtained toner image may be transferred electrostatically to transfer sheet and fixed thereto with a heat-fixing device, to form a copied image.

The image forming method of the exemplary embodiment may employ a non-magnetic single-component developer system.

The aforementioned processes are each an ordinary process, and are described, for example, in JP-A-56-40868, JP-A-49-91231 and the like. The image forming method of the exemplary embodiment may be practiced with a known image forming apparatus, such as a copying machine and a facsimile machine.

The formation of an electrostatic latent image is a process of forming an electrostatic latent image on an image holding member (photoconductor).

The development is a process of developing the electrostatic latent image with a developer layer on a developer holding member, thereby forming a toner image. The developer layer is not particularly limited as far as it contains the toner for developing an electrostatic image of the exemplary embodiment.

The transferring is a process of transferring the toner image to a transfer medium. Examples of the transfer medium in the transferring include an intermediate transfer medium and a recording medium, such as paper.

In the fixing, the toner image transferred on the transfer paper is fixed with a heating roller fixing device having a heating roller with a temperature controlled to a prescribed value, and thereby a copied image is formed.

The image forming method of the exemplary embodiment may contain cleaning. The cleaning is a process of removing and recovering the developer for developing an electrostatic image remaining on the image holding member.

The recording medium used may be a known one. Examples of the recording medium include paper and an OHP sheet, which are used in a copying machine, a printer or the like of an electrophotographic system, and coated paper obtained by coating ordinary paper with a resin or the like on the surface thereof, art paper for printing, and the like may be used.

The image forming method of the exemplary embodiment may further contain recycling. The recycling is a process of moving the toner for developing an electrostatic image thus recovered in the cleaning, to the developer layer. The image forming method of the exemplary embodiment that contains the recycling may be practiced with an image forming apparatus, such as a copying machine and a facsimile machine, with a toner recycling system. The image forming method may also be applied to a recycling system, in which the toner is recovered simultaneously with the development without cleaning.

The image forming apparatus of the exemplary embodiment may contain: an image holding member; a charging unit that charges the image holding member; an exposing unit that exposes the charged image holding member, to form an electrostatic latent image on the image holding member; a developing unit that develops the electrostatic latent image with a toner, to form a toner image; a transferring unit that transfers the toner image from the image holding member to a transfer medium; and a fixing unit that fixes the toner image transferred to the surface of the transfer medium, in which the toner may be the toner for developing an electrostatic image of the exemplary embodiment.

The image forming apparatus of the exemplary embodiment is not particularly limited as far as the image forming apparatus contains at least the image holding member, the charging unit, the exposing unit, the developing unit, the transferring unit and the fixing unit, and may further contain a cleaning unit, an erasing unit and the like depending on necessity.

In the transferring unit, the transferring operation may be performed twice or more by using an intermediate transfer medium. Examples of the transfer medium in the transferring include an intermediate transfer medium and a recording medium, such as paper.

In the image holding member and the units of the image forming apparatus of the exemplary embodiment, the constitutions described for the processes of the image forming method of the exemplary embodiment may be preferably employed. The units may employ the well known units for the image forming apparatus. The image forming apparatus of the exemplary embodiment may further contain other units and devices than the units and devices described above. In the image forming apparatus of the exemplary embodiment, plural units among the units described may be performed simultaneously.

An example of the image forming apparatus of the exemplary embodiment is described with reference to FIG. 1, but the exemplary embodiment is not limited to the example. FIG. 1 is a schematic cross sectional view showing the example of the image forming apparatus using a two-component developer according to the exemplary embodiment.

FIG. 1 is a schematic illustration showing an example of a structure of an image forming apparatus for forming an image according to the image forming method of the exemplary embodiment. The image forming apparatus 200 shown in the figure has inside a housing 400 four electrophotographic photoconductors (image holding members) 401*a* to 401*d* disposed in series along an intermediate transfer belt 409. The electrophotographic photoconductors 401*a* to 401*d* are capable of forming color images, i.e., a yellow image is formed with the electrophotographic photoconductor 401*a*, a magenta image is formed with the electrophotographic photoconductor 401*b*, a cyan image is formed with the electrophotographic photoconductor 401*c*, and a black image is formed with the electrophotographic photoconductor 401*d*.

The electrophotographic photoconductors 401*a* to 401*d* are each rotatable in a prescribed direction (in the counterclockwise direction in the figure), and charging rolls 402*a* to 402*d*, developing devices 404*a* to 404*d*, primary transfer rolls 410*a* to 410*d*, and cleaning blades 415*a* to 415*d* are disposed around the electrophotographic photoconductors 401*a* to 401*d*, respectively, along the rotation direction thereof. The developing devices 404*a* to 404*d* are capable of feeding toners of four colors, yellow, magenta, cyan and black, accommodated in the toner cartridges 405*a* to 405*d*, respectively, and the primary transfer rolls 410*a* to 410*d* are in contact with the electrophotographic photoconductors 401*a* to 401*d*, respectively, through the intermediate transfer belt 409.

An exposing device 403 is disposed at a prescribed position inside the housing 400 and is capable of radiating a light beam emitted from the exposing device 403 onto the surfaces of the electrophotographic photoconductors 401*a* to 401*d* after charging. According to the structure, the processes of charging, exposing, developing, primary transferring and cleaning are performed in the rotation process of each of the electrophotographic photoconductors 401*a* to 401*d*, and thereby toner images of the colors are transferred and layered on the intermediate transfer belt 409.

The charging rolls 402*a* to 402*d* apply a voltage to the electrophotographic photoconductors 401*a* to 401*d*, respectively, to charge the surfaces of the photoconductors to a prescribed potential by bringing an electroconductive member (the charging roll) into contact with the surface of the electrophotographic photoconductor (i.e., the charging). In the exemplary embodiment, charging by a contact charging system may be performed, by using a charging brush, a charging film, a charging tube or the like instead of the charging roll, and a non-contact charging system using corotron or scorotron may also be used.

The exposing device 403 may be, for example, an optical device capable of exposing imagewise the surfaces of the electrophotographic photoconductors 401*a* to 401*d* with a semiconductor laser, LED (light emitting diode), a liquid crystal shutter or the like as a light source.

In the developing devices 404*a* to 404*d*, developing may be performed with an ordinary developing device by contact or non-contact development with the two-component developer for developing an electrostatic image (i.e., the development). The developing device is not particularly limited as far as the developing device uses a two-component developer for developing an electrostatic image, and may be selected from known devices depending on purposes. In the primary transferring, the primary transfer rolls 410*a* to 410*d* are each applied with a primary transfer bias having a reverse polarity to the toners on the image holding members, and thereby the toners of the colors are primarily transferred sequentially from the image holding members to the intermediate transfer belt 409.

The cleaning blades 415*a* to 415*d* each remove the remaining toner added to the surface of the electrophotographic photoconductor after the transferring, and the electrophotographic photoconductor having the surface thus cleaned therewith is then used repeatedly for the next image formation process. Examples of the material of the cleaning blade include urethane rubber, neoprene rubber and silicone rubber.

The intermediate transfer belt 409 is supported under predetermined tension with a driving roll 406, a backup roll 408 and a tension roll 407, and is rotatable through rotation of the rolls without slack. A secondary transfer roll 413 is disposed to be in contact with the backup roll 408 through the intermediate transfer belt 409.

The secondary transfer roll 413 is applied with a secondary transfer bias having a reverse polarity to the toners on the intermediate transfer belt, and thereby the toners are secondarily transferred from the intermediate transfer belt to the recording medium. The surface of the intermediate transfer medium 409 passing through between the backup roll 408 and the secondary transfer roll 413 is then cleaned, for example, with a cleaning blade 416 disposed in the vicinity of the driving roll 406 or an erasing device (which is not shown in the figure), and the intermediate transfer belt is then used repeatedly for the next image formation process. A tray (recording medium tray) 411 is disposed at a prescribed position inside the housing 400, and the recording medium 500, such as paper, in the tray 411 is conveyed with a conveying roll 412 to between the intermediate transfer belt 409 and the secondary transfer roll 413 and then between two fixing rolls 414 in contact with each other, and then delivered outside the housing 400.

An example of an image forming apparatus, in which development is performed with a non-magnetic single-component developer, is described with reference to FIGS. 1 and 2. The image formation may be performed similarly by using a developing device 10 shown in FIG. 2 as each of the developing devices 404*a* to 404*d* in FIG. 1.

The toner for developing an electrostatic image of the exemplary embodiment may be preferably applied to a non-magnetic single-component developer. In the non-magnetic single-component developer system, the surface of the toner receives larger stress, and the silica-containing particles added as an external additive are liable to be buried under the toner, as compared to the two-component developer system. However, it is considered that the use of the toner for developing an electrostatic image of the exemplary embodiment may prevent the silica-containing particles from being buried under the toner even in the non-magnetic single-component developer system.

Figure 2:
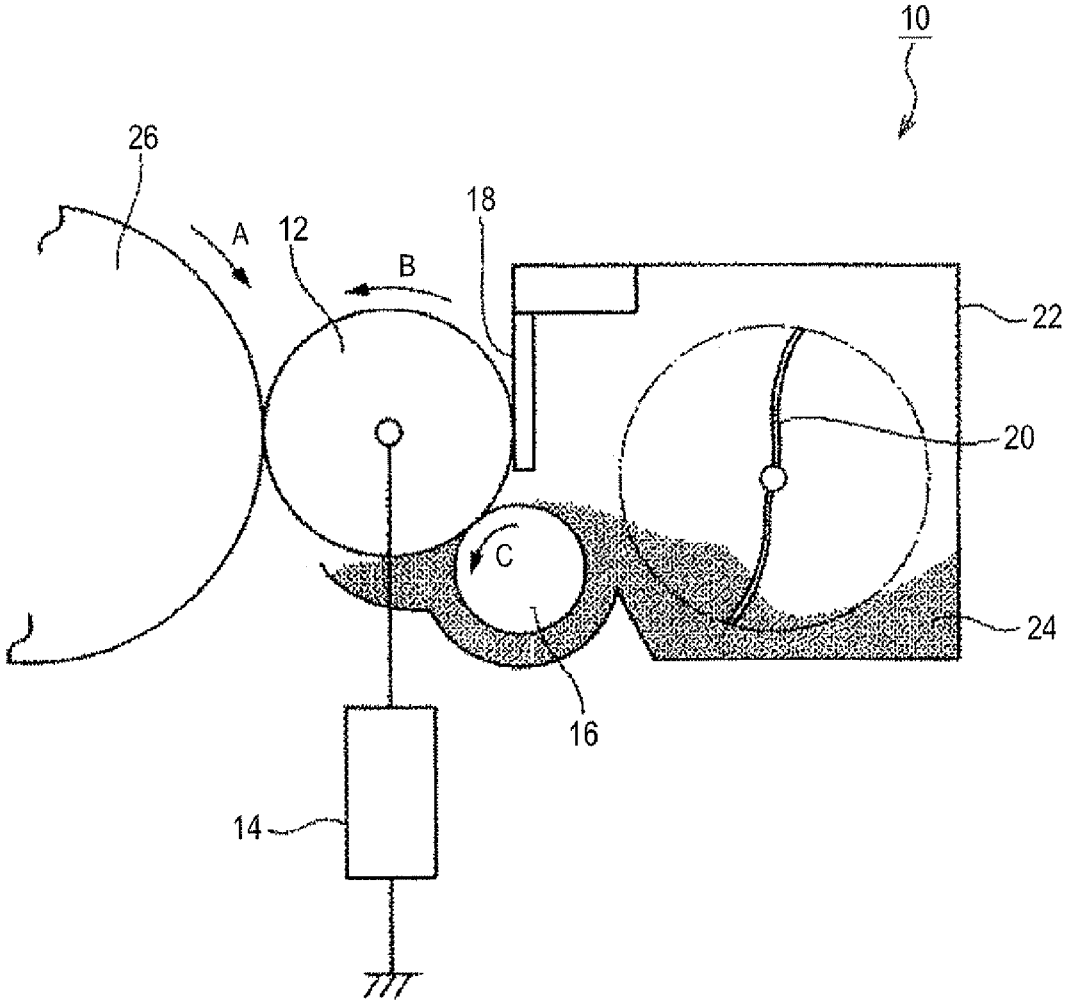
FIG. 2 is a schematic view showing one example of a developing device using a non-magnetic single-component developer according to an exemplary embodiment.

The developing device 10 shown in FIG. 2 contains: a developing roll 12 that is disposed in contact with an image holding member (photoconductor) 26, which is rotatable in the direction shown by the arrow A with a driving power source not shown in the figure, and is capable of being driven and rotated in the direction shown by the arrow B with the rotation of the image holding member 26; a bias power source 14 that is connected to the developing roll 12; a toner scraping member 16 that is disposed in contact with the developing roll 12 under pressure at the position on the downstream side of the position where the developing roll 12 and the image holding member 26 are in contact with each other in the rotation direction of the developing roll 12, and is rotatable in the direction shown by the arrow C opposite to the rotation of the developing roll 12; a toner layer control member 18 that is disposed at the position on the downstream side of the position where the developing roll 12 and the toner scraping member 16 are in contact with each other under pressure and on the upstream side of the position where the developing roll 12 and the image holding member 26 are in contact with each other in the rotation direction of the developing roll 12, and is disposed in contact with the developing roll 12; a housing 22 that is disposed on the side of the developing roll 12 opposite to the side where the image holding member 26 is disposed, and has an opening on the side where the developing roll 12 is disposed; and a stirrer 20 disposed inside the housing 22.

The toner layer control member 18 is fixed at one end thereof to the opening of the housing 22, thereby closing the opening of the housing 22. The opening of the housing 22 on the side (i.e., the lower side of the opening) opposite to the side where the toner layer control member 18 is provided (i.e., the upper side of the opening) is provided to cover the lower side of the developing roll 12 and the toner scraping member 16. The toner (i.e., the non-magnetic single-component developer) 24 is disposed as being accumulated on the lower side of the housing 22, and is accumulated in such a manner that the toner fills in the space between the lower side of the developing roll 12 and the lower side of the opening of the housing 22 with no space and covers the toner scraping member 16. The toner 24 is appropriately fed with the stirrer 20 provided inside the housing 22 from the interior of the housing 22 to the side of the opening of the housing 22 where the developing roll 12 is provided.

Upon development, the toner 24 in the housing 22 is fed to the surface of the developing roll 12 with the stirrer 20 and the toner scraping member 16. The toner 24 added to the surface of the developing roll 12 is then added to form a toner layer having a uniform thickness on the surface of the developing roll 12 with the toner layer control member 18. Subsequently, the toner 24 added to the surface of the developing roll 12 is transferred to the image holding member 26 having an electrostatic latent image (which is not shown in the figure) formed thereon through the difference in potential between the surface of the image holding member 26 and the developing roll 12, which is applied with a bias voltage from a bias power source 14, thereby developing the electrostatic latent image. The toner 24 remaining on the surface of the developing roll 12 after completing the development is scraped off with the toner scraping member 16.

EXAMPLES

The exemplary embodiments are described in more detail with reference to examples and comparative examples below, but the invention is not limited to the examples. All the terms "part" and "%" in the following description indicate "part by weight" and "% by weight", respectively, unless otherwise indicated.

Measurement Method of Exposure Ratio of Surface of Colored Particles

The exposure ratio (E) of the surface of the colored particles is obtained from a measured coverage of the silica-containing particles Cs on the surface of the colored particles and a measured coverage of the titanium-containing particles Ct on the surface of the colored particles. Specifically, the measured coverages Cs and Ct are obtained by measuring the colored particles solely, the silica-containing particles solely, the titanium-containing particles solely, and the toner containing the silica-containing particles and the titanium-containing particles, for signal intensities of silicon atom and titanium atom respectively with an X-ray photoelectron spectroscopy (XPS) apparatus (JPS-9000MX, available from JEOL, Ltd.), and calculating according to the following expressions (1) and (2).

$$Cs=(Ps-Ns)/(Ts-Ns)\times 100(\%) \quad (1)$$

$$Ct=(Pt-Nt-Cs\times Tt)/(St-Nt)\times 100(\%) \quad (2)$$

Accordingly, the exposure ratio (E) is calculated according to the following expression (3).

$$E=100-Cs-Ct(\%) \quad (3)$$

In the expressions (1) and (2), Ps represents the signal intensity of silicon atom derived from the silica-containing particles and the titanium-containing particles of the toner containing the silica-containing particles and the titanium-containing particles, Pt represents the signal intensity of titanium atom derived from the silica-containing particles and the titanium-containing particles of the toner, St represents the signal intensity of titanium atom derived from the silica-containing particles of the silica-containing particles solely, Ts represents the signal intensity of silicon atom derived from the titanium-containing particles of the titanium-containing particles solely, Tt represents the signal intensity of titanium atom derived from the titanium-containing particles of the titanium-containing particles solely, Ns represents the signal intensity of silicon atom of the colored particles solely, and Nt represents the signal intensity of titanium atom of the colored particles solely.

Measurement Method of Ratio of Silica-Containing Particles that are in Contact with Surface of Colored Particles A micrograph of the toner with a magnification of 30,000 is taken with a scanning electron microscope (FE-SEM S-4700, available from Hitachi, Ltd.). The number of the silica-containing particles that are in contact with the colored particles is counted visually, and the ratio of the silica-containing particles that are in contact with the surface of the colored particles is calculated. In the exemplary embodiment, 10 particles of the toner are measured, and the average value thereof is designated as the ratio of the silica-containing particles that are in contact with the surface of the colored particles (% by number).

In the visual determination as to whether or not a silica-containing particle is in contact with a colored particle, it is determined that the silica-containing particle is not in contact with the colored particle in the case where a titanium-containing particle under the silica-containing particle is visually observed around the silica-containing particle, and it is determined that the silica-containing particle is in contact with the colored particle in the case where a titanium-containing particle under the silica-containing particle is not visually observed around the silica-containing particle.

Synthesis of Amorphous Polyester Resin 90 parts by mol of polyoxyethylene (2,0)-2,2-bis(4-hydroxyphenyl)propane, 10 parts by mol of ethylene glycol, 80 parts by mol of terephthalic acid and 20 parts by mol of isophthalic acid as raw materials and dibutyltin oxide as a catalyst are put into a two-neck flask having been dried by heating, and the content of the flask is heated while maintaining the interior of the flask inert by introducing nitrogen gas. The temperature of the content of the flask is then maintained at 150 to 230° C. for about 12 hours for performing copolycondensation reaction, and then the pressure is gradually decreased at 210 to 250° C., thereby synthesizing an amorphous polyester resin (1).

The amorphous polyester resin (1) has a weight average molecular weight (Mw) of 23,200. The amorphous polyester resin (1) has an acid value of 14.2 KOHmg/g. The amorphous polyester resin (1) has a glass transition temperature (Tg) of 62° C.

Production of Silica Particles

Silica sol produced by a sol-gel method is subjected to HMDS (hexamethyldisilazane) treatment, and then dried and pulverized, thereby providing silica particles (1) having an average particle diameter of 12 nm.

Production of Metatitanic Acid Particles

Ilmenite as ore is dissolved in sulfuric acid, iron powder is separated, and $TiO(OH)_2$ is produced by a wet sedimentation method where $TiO(OH)_2$ is formed by hydrolyzing $TiOSO_4$. During the production of $TiO(OH)_2$, hydrolysis, dispersion control for formation of nuclei, and rinsing with water are performed. 100 parts of $TiO(OH)_2$ thus obtained is dispersed in 1,000 parts of water, to which 40 parts of isobutyltrimethoxysilane is added at room temperature (25° C.) dropwise under stirring. Thereafter, the mixture is filtered and repeatedly rinsed with water. The obtained metatitanic acid particles having been subjected to a surface hydrophobic treatment with isobutyltrimethoxysilane are dried at 150° C., thereby providing metatitanic acid particles (1) (titanium particles (1)) having a volume average particle diameter of 20 nm, a BET specific surface area of 120 $m^2/g$ and a specific gravity of 4.2.

Production of Release Agent Dispersion Liquid

| | |
|---|---|
| Paraffin wax (HNP-9, available from Nippon Seiro Co., Ltd., melting point: 75° C.) | 50 parts |
| Anionic surfactant (Neogen RK, available from Daiichi Kogyo Seiyaku Co., Ltd.) | 0.5 part |
| Ion exchanged water | 200 parts |

The aforementioned components are mixed and heated to 95° C., and then dispersed with a homogenizer (Ultra-Turrax T50, available from IKA Works, Inc.). Thereafter, the mixture is dispersed with Manton Gaulin High-pressure Homogenizer (available from Gaulin, Inc.), thereby preparing a release agent dispersion liquid having the release agent dispersed therein (solid concentration: 20%). The release agent in the release agent dispersion liquid has a volume average particle diameter of 0.23 μm.

Production of Colorant Dispersion Liquid

| | |
|---|---|
| Cyan pigment (C.I. Pigment Blue 15:3 (copper phthalocyanine), available from Dainichiseika Colour & Chemicals Mfg. Co., Ltd.) | 1,000 parts |
| Anionic surfactant (Neogen R, available from Daiichi Kogyo Seiyaku Co., Ltd.) | 15 parts |
| Ion exchanged water | 9,000 parts |

The aforementioned components are mixed and dissolved, and then dispersed with a high-pressure impact dispersing machine, Altimizer (HJP 30006 available from Sugino Machine, Ltd.) for 1 hour, thereby preparing a colorant dispersion liquid having a colorant (cyan pigment) dispersed therein. The colorant dispersion liquid has a volume average particle diameter of the colorant (cyan pigment) of 0.16 μm and a solid concentration of 20%.

Example 1

Production of Toner (1)

| Mixing | |
|---|---|
| Amorphous polyester resin dispersion liquid (1) | 267 parts |
| Colorant dispersion liquid | 25 parts |
| Release agent dispersion liquid | 40 parts |
| Anionic surfactant (Tayca Power, available from Tayca Corporation) | 2.0 parts |

The aforementioned components are put into a cylindrical stainless steel vessel and mixed with a homogenizer (Ultra-Turrax T50, available from IKA Works, Inc.) while applying a shearing force at a rotation number of the homogenizer of 4,000 rpm for 10 minutes. Thereafter, 2.0 parts of a 10% nitric acid aqueous solution of polyaluminum chloride (PAC) as an aggregating agent (nitric acid content: 0.05 N) is gradually added dropwise thereto while mixing with a homogenizer at a rotation number of 5,000 rpm over 15 minutes, thereby providing a raw material dispersion liquid.

Aggregation

Thereafter, the raw material dispersion liquid is placed and heated in a polymerization vessel equipped with a stirring device and a thermometer, and heated by a mantle heater, and growth of aggregated particles is accelerated at 42° C. At this time, the pH of the raw material dispersion liquid is controlled to a range of from 3.2 to 3.8 with 0.3 N nitric acid or a 1 N sodium hydroxide aqueous solution. The raw material dispersion liquid is retained for about 2 hours while maintaining the pH within the range, thereby forming aggregated particles. The aggregated particles have a volume average particle diameter of 5.4 μm.

Coalescence 100 parts of the amorphous polyester resin dispersion liquid (1) is further added to the raw material dispersion liquid, and thereby the resin particles of the amorphous polyester resin (1) are added to the surface of the aggregated particles. The temperature of the raw material dispersion liquid is then increased to 44° C., and the aggregated particles are regulated while confirming the size and shape of the particles with an optical microscope and Multisizer II. Thereafter, for coalescing the aggregated particles, the pH of the raw material dispersion liquid is adjusted to 7.5 by adding a sodium hydroxide aqueous solution dropwise thereto, and then the temperature of the raw material dispersion liquid is increased to 95° C. Thereafter, the aggregated particles are coalesced by retaining the raw material dispersion liquid for 3 hours, and after confirming that the aggregated particles are coalesced with an optical microscope, the obtained colored particle dispersion liquid is cooled at a temperature decreasing rate of 1.0° C. per minute.

Rinsing

The colored particle dispersion liquid is filtered for solid-liquid separation, and the colored particles are then dispersed in ion exchanged water in an amount of 20 times as much as the amount of the solid content of the colored particles at 30° C., and stirred for 20 minutes, followed by filtration. The rinsing operation is repeated 5 times, and then it is confirmed that the filtrate has an electroconductivity of 25 μS. The colored particles are filtered and dried in a freeze dryer, thereby providing colored particles (1).

Addition of Titanium Particles

The colored particles dispersion liquid having been subjected to the rinsing is controlled to have a solid concentration of 40% by filtration and dilution with ion exchanged water. The titanium particles (1) are dispersed in a mixed liquid of methanol and water at a ratio methanol/water of 50/50, and the mixture is gradually diluted with ion exchanged water, thereby controlling the mixture to provide a titanium particle dispersion liquid having a solid concentration of the titanium particles of 42%. The titanium particle dispersion liquid thus obtained is a mixed liquid of methanol and water at a ratio of 20/80. 1.84 parts by weight based on the colored particles of the titanium particle dispersion liquid (corresponding to a coverage of 100%) is gradually added dropwise to the colored particles dispersion liquid under stirring. Thereafter, the pH is decreased to 4.0 by adding 0.3 N nitric acid dropwise thereto, and the dispersion liquid is stirred for 30 minutes and then filtered. Ion exchanged water in an amount providing a solid concentration of 10% is slowly added dropwise to the solid matter, and the mixture is stirred for 30 minutes and then filtered again. The obtained solid matter is put into a vacuum freeze dryer and dried at 25° C. for 24 hours, thereby providing the colored particles having the titanium-containing particles added (1).

Observation of the surface of the colored particles having the titanium-containing particles added (1) with an SEM reveals that the titanium particles are added uniformly to the surface of the colored particles.

Dry External Addition 100 parts of the colored particles having the titanium-containing particles added (1) and 0.98 part of the silica particles (1) (corresponding to a coverage of 30%) are put into a Henschel mixer and mixed at a rotation number of 2,200 rpm for 2.5 minutes. The mixture is then sieved with a 45 μm-sieve, thereby providing a toner (1).

The toner (1) has an exposure ratio of 21% measured by XPS, and a ratio of the silica particles that are in contact with the surface of the colored particles of 7% by number measured with SEM.

In the toner (1), the titanium-containing particles are added in the form of single layer to the surface of the colored particles as shown in the state (c) in FIG. 3, and the silica-containing particles are present mainly on the titanium-containing particles.

Evaluation

The toner thus obtained is evaluated with a modified machine of XP-15, available from Fuji Xerox Co., Ltd., having a four-stage tandem image forming mechanism, a blade frictional charging mechanism and a non-contact developing system. The evaluations are performed under the same conditions after maintaining the toner and the machine under an environment of 40° C. and 85% RH for 17 hours.

Evaluation of White Streaks

An image pattern having black solid images each having a square shape with an edge length of 3 cm disposed at the upper left, center and lower right positions of the paper is printed continuously on C2 paper for 10,000 sheets. The black solid images and the blade of the 10,000th print are evaluated according to the following evaluation standard. The results are shown in Table 1.

G1: no white streak is found on the black solid image, and no deposition of toner is found on the blade in the developing device G2: deposition of toner is found on the blade in the developing device, but no white streak is found on the black solid image G3: deposition of toner is found on the blade in the developing device, and slight white streaks are found on the black solid image G4: white streaks are found over the entire black solid image Image Density Stability The images of the 10th print and the 5,000th print are measured for density with an image densitometer (X-Rite 404A, available from X-Rite, Inc.), and the measurement results are evaluated according the following evaluation standard. The results are shown in Table 1.

G1: The image density of 5,000th print is 97% or more of that of the 10th print.

G2: The image density of 5,000th print is 94% or more and less than 97% of that of the 10th print.

G3: The image density of 5,000th print is 90% or more and less than 94% of that of the 10th print.

G4: The image density of 5,000th print is less than 90% of that of the 10th print.

Addition to Surface of Photoconductor

After printing the image for 10,000 sheets, the additions on the photoconductor are visually observed and evaluated according the following evaluation standard. The results are shown in Table 1.

G1: no addition is observed on the photoconductor

G2: slight additions are observed on the photoconductor

G3: slight additions grown as streaks are observed on the photoconductor

G4: additions are observed substantially all over the photoconductor

Example 2

Production of Toner (2)

A toner (2) is produced in the same manner as in the toner (1) except that the amount of the titanium particles in the addition of the titanium particles from 1.84 parts to 2.39 parts (corresponding to a coverage of 130%), and the amount of the silica particles (1) in the dry external addition from 0.98 part to 0.65 part (corresponding to a coverage of 20%).

The toner (2) has an exposure ratio of 18% measured by XPS, and a ratio of the silica particles that are in contact with the surface of the colored particles of 6% by number measured with SEM.

Example 3

Production of Toner (3)

A toner (3) is produced in the same manner as in the toner (1) except that the amount of the silica particles (1) in the dry external addition from 0.98 part to 0.26 part (corresponding to a coverage of 8%).

The toner (3) has an exposure ratio of 22% measured by XPS, and a ratio of the silica particles that are in contact with the surface of the colored particles of 4% by number measured with SEM.

Example 4

Production of Toner (4)

A toner (4) is produced in the same manner as in the toner (1) except that the amount of the titanium particles in the addition of the titanium particles from 1.84 parts to 2.39 parts (corresponding to a coverage of 130%), and the amount of the silica particles (1) in the dry external addition from 0.98 part to 1.96 part (corresponding to a coverage of 60%).

The toner (4) has an exposure ratio of 16% measured by XPS, and a ratio of the silica particles that are in contact with the surface of the colored particles of 8% by number measured with SEM.

Example 5

Production of Toner (5)

A toner (5) is produced in the same manner as in the toner (1) except that the amount of the titanium particles in the addition of the titanium particles from 1.84 parts to 1.56 parts (corresponding to a coverage of 85%), and the amount of the silica particles (1) in the dry external addition from 0.98 part to 0.49 part (corresponding to a coverage of 15%).

The toner (5) has an exposure ratio of 24% measured by XPS, and a ratio of the silica particles that are in contact with the surface of the colored particles of 6% by number measured with SEM.

Example 6

Production of Toner (6)

A toner (6) is produced in the same manner as in the toner (1) except that the amount of the titanium particles in the addition of the titanium particles from 1.84 parts to 2.76 parts (corresponding to a coverage of 150%), and the amount of the silica particles (1) in the dry external addition from 0.98 part to 1.47 part (corresponding to a coverage of 45%).

The toner (6) has an exposure ratio of 12% measured by XPS, and a ratio of the silica particles that are in contact with the surface of the colored particles of 8% by number measured with SEM.

Example 7

Production of Toner (7)

A mixture of 380 parts of styrene, 25 parts of n-butyl acrylate, 5 parts of acrylic acid and 25 parts of dodecanethiol dissolved therein is added to a flask containing 8 parts of a nonionic surfactant (Nonipol 400, available from Sanyo Chemical Industries, Ltd.) and 9 parts of an anionic surfactant (Neogen SC, available from Daiichi Kogyo Seiyaku Co., Ltd.) dissolved in 550 parts of ion exchanged water, to which 50 parts of ion exchanged water containing 5 parts of ammonium persul fate dissolved therein is added, and the mixture is slowly stirred over 30 minutes to perform emulsion polymerization. After replacing the interior of the flask with nitrogen, the content of the flask is heated to 75° C. over an oil bath under stirring, and then the emulsion polymerization is performed by maintaining the temperature for 4 hours. As a result, resin particle dispersion liquid (7) containing resin particles having a diameter of 131 nm, a glass transition temperature Tg of 60° C. and a weight average molecular weight Mw of 11,000 dispersed therein is obtained. The dispersion liquid has a solid concentration of 42%.

60 parts of a cyan pigment (C.I. Pigment Blue15:3), 5 parts of a nonionic surfactant (Nonipol 400, available from Sanyo Chemical Industries, Ltd.) and 240 parts of ion exchanged water are mixed and stirred with a homogenizer (Ultra-Turrax T50, available from IKA Works, Inc.) for 30 minutes, and then the mixture is dispersed with Altimizer, thereby preparing a colorant dispersion (7) containing colorant (cyan pigment) particles having an average particle diameter of 2.20 nm dispersed therein.

100 parts of paraffin wax (HNP0190, available from Nippon Seiro Co., Ltd., melting point: 85° C.), 5 parts of a cationic surfactant (Sanisol B50, available from Kao Corporation) and 240 parts of ion exchanged water are dispersed in a round-bottom stainless steel flask with a homogenizer (Ultra-Turrax T50, available from IKA Works, Inc.) for 30 minutes, and then further dispersed with a pressure discharge homogenizer, thereby preparing a release agent dispersion liquid (7) containing release agent particles having an average particle diameter of 523 nm dispersed therein.

Subsequently, 240 parts of the resin particle dispersion liquid (7), 25 parts of the colorant dispersion liquid (7), 45 parts of the release agent dispersion liquid (7), 0.8 part of polyaluminum hydroxide (Paho 2S, available from Asada Chemical Industry Co., Ltd.) and 800 parts of ion exchanged water are mixed and dispersed in a round-bottom stainless steel flask with a homogenizer (Ultra-Turrax T50, available from IKA Works, Inc.). For aggregating fine particles, the content of the flask is heated to 42° C. over an oil bath under stirring, and maintained at that temperature for 30 minutes, and then the content of the flask is further maintained at 58° C. for 60 minutes by increasing the temperature of the oil bath. The particles contained in the slurry are measured for size, and the weight average particle diameter $D_{50}$ thereof is 5.6 μm. Thereafter, for controlling the shape of the aggregated particles, a 1 N sodium hydroxide solution is added to the slurry containing the aggregated particles, thereby regulating the pH of the system to 7.2, the stainless steel flask is sealed, and the content of the flask is heated to 83° C. and maintained at that temperature for 4 hours under continuous stirring with a magnetic seal. After cooling the content, the obtained toner mother particles are separated by filtration, rinsed with ion exchanged water 4 times, and then freeze-dried, thereby providing toner mother particles.

The particles are subjected to the addition of the titanium particles and the dry external addition in the same manner as in the toner (1), thereby producing a toner (7).

The toner (7) has an exposure ratio of 23% measured by XPS, and a ratio of the silica particles that are in contact with the surface of the colored particles of 8% by number measured with SEM.

Example 8

Production of Toner (8)

A toner (8) is produced in the same manner as in the toner (1) except that the titanium particles (1) are replaced by 1.84 parts of the rutile type titanium particles (2) (corresponding to a coverage of 100%) in the addition of the titanium particles.

The toner (8) has an exposure ratio of 22% measured by XPS, and a ratio of the silica particles that are in contact with the surface of the colored particles of 7% by number measured with SEM.

Example 9

Production of Toner (9)

A toner (9) is produced in the same manner as in the toner (1) except that the silica particles (1) are replaced by 0.98 part of the silica particles (2) having been subjected to a surface treatment with a silicone oil (corresponding to a coverage of 30%) in the dry external addition.

The toner (9) has an exposure ratio of 20% measured by XPS, and a ratio of the silica particles that are in contact with the surface of the colored particles of 6% by number measured with SEM.

Comparative Example 1

Production of Toner (10)

A toner (10) is produced in the same manner as in the toner (1) except that the titanium particles are not added, and 0.98 part of the silica particles (1) (corresponding to a coverage of 30%) are added by wet external addition.

The toner (10) has an exposure ratio of 86% measured by XPS, and a ratio of the silica particles that are in contact with the surface of the colored particles of 100% by number measured with SEM.

Comparative Example 2

Production of Toner (11)

A toner (11) is produced in the same manner as in the toner (1) except that the silica particles are not added by dry external addition.

The toner (11) has an exposure ratio of 22% measured by XPS, and a ratio of the silica particles that are in contact with the surface of the colored particles of 0% by number measured with SEM.

Comparative Example 3

Production of Toner (12)

Subsequent to the rinsing in the production of the toner (1), 100 parts of the colored particles (1) and 1.84 parts of the titanium particles (1) (corresponding to a coverage of 100%) are put into a Henschel mixer and mixed at a rotation number of 2,200 rpm for 2.5 minutes. The mixture is sieved with a 45 μm-sieve, thereby providing colored particles having the titanium-containing particles added (12). Thereafter, 100 parts of the colored particles having the titanium-containing particles added (12) and 0.98 part of the silica particles (1) (corresponding to a coverage of 30%) are put into a Henschel mixer and mixed at a rotation number of 2,200 rpm for 2.5 minutes. The mixture is sieved with a 45 μm-sieve, thereby providing a toner (12).

The toner (12) has an exposure ratio of 52% measured by XPS, and a ratio of the silica particles that are in contact with the surface of the colored particles of 23% by number measured with SEM.

In the toner (12), it is observed that the surface of the colored particles frequently has portions where both the titanium-containing particles and the silica-containing particles are not added, as similar to the state (a) in FIG. 3.

Comparative Example 4

Production of Toner (13)

Subsequent to the rinsing in the production of the toner (1), 100 parts of the colored particles (1) and 1.56 parts of the titanium particles (1) (corresponding to a coverage of 85%) are put into a Henschel mixer and mixed at a rotation number of 2,200 rpm for 2.5 minutes. The mixture is sieved with a 45 μm-sieve, thereby providing colored particles having the titanium-containing particles added (13). Thereafter, 100 parts of the colored particles having the titanium-containing particles added (13) and 1.96 part of the silica particles (1) (corresponding to a coverage of 60%) are put into a Henschel mixer and mixed at a rotation number of 2,200 rpm for 2.5 minutes. The mixture is sieved with a 45 μm-sieve, thereby providing a toner (13).

The toner (13) has an exposure ratio of 20% measured by XPS, and a ratio of the silica particles that are in contact with the surface of the colored particles of 13% by number measured with SEM.

Comparative Example 5

Production of Toner (14)

A toner (14) is produced in the same manner as in the toner (1) except that the titanium particles (1) are not added in the addition of the titanium particles, but 1.84 parts of the titanium particles (1) (corresponding to a coverage of 100%) and 0.98 part of the silica particles (1) (corresponding to a coverage of 30%) are simultaneously added externally to 100 parts of the colored particles (1) in a Henschel mixer and mixed at a rotation number of 2,200 rpm for 2.5 minutes. The mixture is sieved with a 45 μm-sieve, thereby providing a toner (14).

The toner (14) has an exposure ratio of 19% measured by XPS, and a ratio of the silica particles that are in contact with the surface of the colored particles of 21% by number measured with SEM.

Comparative Example 6

Production of Toner (15)

Subsequent to the rinsing in the production of the toner (1), 100 parts of the colored particles (1) and 3.68 parts of the titanium particles (1) (corresponding to a coverage of 200%) are put into a Henschel mixer and mixed at a rotation number of 2,200 rpm for 2.5 minutes. The mixture is sieved with a 45 μm-sieve, thereby providing colored particles having the titanium-containing particles added (15). Thereafter, 100 parts of the colored particles having the titanium-containing particles added (15) and 1.96 parts of the silica particles (1) (corresponding to a coverage of 60%) are put into a Henschel mixer and mixed at a rotation number of 2,200 rpm for 2.5 minutes. The mixture is sieved with a 45 μm-sieve, thereby providing a toner (15).

The toner (15) has an exposure ratio of 28% measured by XPS, and a ratio of the silica particles that are in contact with the surface of the colored particles of 12% by number measured with SEM.

Tables 1 and 2 below show the evaluation results of the toners for developing an electrostatic image of Examples 1 to 9 and Comparative Examples 1 to 6.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| Binder resin | | resin (1) | resin (1) | resin (1) | resin (1) | resin (1) | resin (1) | resin (2) | resin (1) | resin (1) |
| Toner | | toner (1) | toner (2) | toner (3) | toner (4) | toner (5) | toner (6) | toner (7) | toner (8) | toner (9) |
| Volume average particle diameter of toner (μm) | | 5.4 | 5.4 | 5.4 | 5.4 | 5.4 | 5.4 | 5.4 | 5.4 | 5.4 |
| Titanium-containing particles | Kind | particle (1) | particle (1) | particle (1) | particle (1) | particle (1) | particle (1) | particle (1) | particle (2) | particle (1) |
| | Coverage (%) | 100 | 130 | 100 | 130 | 85 | 150 | 100 | 100 | 100 |
| Silica-containing particles | Kind | particle (1) | particle (1) | particle (1) | particle (1) | particle (1) | particle (1) | particle (1) | particle (1) | particle (2) |
| | Coverage (%) | 30 | 20 | 8 | 60 | 15 | 45 | 30 | 30 | 30 |
| External addition method of titanium particles | | wet method | wet method | wet method | wet method | wet method | wet method | wet method | wet method | wet method |
| Exposure ratio of colored particles (%) | | 21 | 18 | 22 | 16 | 24 | 12 | 23 | 22 | 20 |
| Contact ratio of silica-containing particles (% by number) | | 7 | 6 | 4 | 8 | 6 | 8 | 8 | 7 | 6 |
| Evaluation | White streaks | G2 | G1 | G2 | G2 | G3 | G1 | G2 | G2 | G2 |
| | Image density stability | G1 | G2 | G3 | G1 | G3 | G1 | G3 | G2 | G1 |
| | Addition to surface of photoconductor | G1 | G2 | G1 | G3 | G1 | G3 | G3 | G3 | G3 |

TABLE 2

| | | Comparative Example 1 | Comparative Example 2 | Comparative Example 3 | Comparative Example 4 | Comparative Example 5 | Comparative Example 6 |
|---|---|---|---|---|---|---|---|
| Binder resin | | resin (1) | resin (1) | resin (1) | resin (1) | resin (1) | resin (1) |
| Toner | | toner (10) | toner (11) | toner (12) | toner (13) | toner (14) | toner (15) |
| Volume average particle diameter of toner (μm) | | 5.4 | 5.4 | 5.4 | 5.4 | 5.4 | 5.4 |
| Titanium-containing particles | Kind | — | particle (1) | particle (1) | particle (1) | particle (1) | particle (1) |
| | Coverage (%) | — | 100 | 100 | 85 | 100 | 200 |
| Silica-containing particles | Kind | particle (1) | — | particle (1) | particle (1) | particle (1) | particle (1) |
| | Coverage (%) | 30 | — | 30 | 60 | 30 | 60 |

TABLE 2-continued

| | | Comparative Example 1 | Comparative Example 2 | Comparative Example 3 | Comparative Example 4 | Comparative Example 5 | Comparative Example 6 |
|---|---|---|---|---|---|---|---|
| External addition method of titanium particles | | — | wet method | dry method | dry method | dry method | dry method |
| Exposure ratio of colored particles (%) | | 86 | 22 | 52 | 20 | 19 | 28 |
| Contact ratio of silica-containing particles (% by number) | | 100 | 0 | 23 | 13 | 21 | 12 |
| Evaluation | White streaks | G4 | G2 | G3 | G3 | G2 | G2 |
| | Image density stability | G4 | G4 | G4 | G4 | G4 | G4 |
| | Addition to surface of photoconductor | G1 | G1 | G3 | G1 | G1 | G4 |
| Remarks | | no titanium particle | no silica particle | | | | |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for developing an electrostatic image, comprising:

colored particles containing a colorant and a binder resin, and two or more kinds of inorganic particles that are externally added to a surface of the colored particles, wherein the two or more kinds of inorganic particles contain titanium-containing particles and silica-containing particles, an exposure ratio of the surface of the colored particles is about 25% or less, a coverage of the silica-containing particles on the colored particles is from 20% to 45%, wherein a coverage of the titanium-containing particles on the colored particles is from about 90% to about 135%, and a ratio of the silica-containing particles that are in contact with the colored particles is about 10% by number or less.

2. The toner for developing an electrostatic image according to claim 1, wherein a total of a coverage of the titanium-containing particles and a coverage of the silica-containing particles on the colored particles is about 150% or less.

3. The toner for developing an electrostatic image according to claim 1, wherein the exposure ratio of the surface of the colored particles is about 2% or more.

4. The toner for developing an electrostatic image according to claim 1, wherein the silica-containing particles have a volume average particle diameter of from about 5 nm to about 40 nm.

5. The toner for developing an electrostatic image according to claim 1, wherein the titanium-containing particles have a volume average particle diameter of from about 8 nm to about 50 nm.

6. The toner for developing an electrostatic image according to claim 1, wherein a ratio of coverage of the titanium-containing particles to the silica-containing particles is from about 1/1 to about 1/10 based on the addition amounts.

7. A method of producing the toner for developing an electrostatic image according to claim 1, comprising:

preparing colored particles containing a colorant and a binder resin;

adding titanium-containing particles to the colored particles in an aqueous medium, through wet external addition to provide colored particles having the titanium-containing particles added; and adding silica-containing particles to the colored particles having the titanium-containing particles added, through dry external addition.

8. The method of producing the toner for developing an electrostatic image according to claim 7, wherein a total of a coverage of the titanium-containing particles and a coverage of the silica-containing particles on the colored particles is about 150% or less.

9. The method of producing the toner for developing an electrostatic image according to claim 7, wherein the exposure ratio of the surface of the colored particles is about 2% or more.

10. An image forming method comprising:

forming an electrostatic latent image on a surface of an image holding member;

developing the electrostatic latent image formed on the surface of the image holding member, with a toner, to form a toner image;

transferring the toner image to a surface of a transfer medium; and fixing the toner image transferred to the surface of the transfer medium, wherein the toner is the toner for developing an electrostatic image according to claim 1.

11. The image forming method according to claim 10, wherein a total of a coverage of the titanium-containing particles and a coverage of the silica-containing particles on the colored particles is about 150% or less.

12. The toner for developing an electrostatic image according to claim 1, wherein the ratio of the silica-containing particles that are in contact with the colored particles is from about 4% to about 10% by number.

* * * * *